US009241554B1

(12) United States Patent
Tong

(10) Patent No.: US 9,241,554 B1
(45) Date of Patent: Jan. 26, 2016

(54) COMBINATION LUGGAGE AND DRINK HOLDER ASSEMBLY

(71) Applicant: Joy Tong, Boca Raton, FL (US)

(72) Inventor: Joy Tong, Boca Raton, FL (US)

( * ) Notice: Subject to any disclaimer, the term of this patent is extended or adjusted under 35 U.S.C. 154(b) by 0 days.

(21) Appl. No.: 14/677,178

(22) Filed: Apr. 2, 2015

(51) Int. Cl.

| | |
|---|---|
| ***A47G 29/18*** | (2006.01) |
| ***A47G 29/24*** | (2006.01) |
| ***A45C 13/00*** | (2006.01) |
| ***A45C 5/03*** | (2006.01) |
| ***A45F 5/00*** | (2006.01) |

(52) U.S. Cl.
CPC . *A45C 13/00* (2013.01); *A45C 5/03* (2013.01); *A45F 5/00* (2013.01); *A45F 2005/002* (2013.01)

(58) Field of Classification Search
CPC ..... A45C 13/00; A45C 5/03; A45F 5/00; A45F 2005/002; B60N 3/102; B60N 3/108; A47G 23/0225; A47G 23/0216
USPC ..... 248/213.2, 311.2, 309.1
See application file for complete search history.

(56) References Cited

U.S. PATENT DOCUMENTS

| | | | | |
|---|---|---|---|---|
| 4,828,211 | A | 5/1989 | McConnell et al. | |
| 5,014,956 | A | 5/1991 | Kayali | |
| 5,072,909 | A | 12/1991 | Huang | |
| 5,191,679 | A | 3/1993 | Harper | |
| 5,342,009 | A * | 8/1994 | Lehner | A47G 23/0225 248/284.1 |
| 6,655,563 | B2 | 12/2003 | Shimajiri | |
| 2003/0015638 | A1 * | 1/2003 | Yamada | B60N 3/102 248/311.2 |
| 2003/0019993 | A1 * | 1/2003 | Yamada | B60N 3/102 248/311.2 |
| 2006/0037825 | A1 * | 2/2006 | Dayton | A45C 13/28 190/110 |
| 2006/0219745 | A1 * | 10/2006 | Riley | A47G 23/0225 224/400 |
| 2010/0051633 | A1 * | 3/2010 | Porte | A45C 5/14 220/737 |
| 2012/0067683 | A1 * | 3/2012 | Cummins | A45F 5/00 190/115 |
| 2013/0092808 | A1 | 4/2013 | Adachi et al. | |
| 2013/0126686 | A1 * | 5/2013 | Ballou | A47G 23/0225 248/205.2 |

* cited by examiner

*Primary Examiner* — Mark Wendell
(74) *Attorney, Agent, or Firm* — Pai Patent & Trademark Law Firm; Chao-Chang David Pai

(57) ABSTRACT

A combination luggage and drink holder assembly includes a luggage, and a drink holder pivotally mounted at the luggage and including a base frame, a hoop pivotally coupled to the top side of the base frame, a tray pivotally coupled to the bottom side of the base frame and two links coupled between the hoop and the tray. The base frame has a structure for supporting the hoop and the tray securely in the extended or received position. The hoop defines a locating hole at the center and a peripheral wall around the border. When the drink holder is set in the received position, the peripheral wall of the hoop surrounds the base frame and the tray, and the tray blocks up the locating hole of the hoop.

6 Claims, 8 Drawing Sheets

COMBINATION LUGGAGE AND DRINK HOLDER ASSEMBLY

BACKGROUND OF THE INVENTION (a) Field of the Invention

The present invention relates to luggage technology, and more particularly to a combination luggage and drink holder assembly that comprises a luggage, and a drink holder mounted at one side of the luggage and biasable relative to the luggage between an extended position and a received position.

(b) Description of the Prior Art

When traveling, people usually carry personal items in a luggage. When a luggage user is carrying a luggage or waiting in an airport or railway station, the user may simultaneously hold a beverage can or drink cup in the hand. Because the luggage provides no drink holder means for holding the beverage can or drink cup, the user must keep holding the beverage can or drink cup in the hand. Further, many drink holder designs for use in a car compartment or other fixed objects are known. Some of these drink holder designs are not collapsible. Some others are collapsible. A known collapsible drink holder is so designed that a tray is turned from the bottom side to the top side to cover on a cup hoop when the user collapses the drink holder. Similar designs are seen in U.S. Pat. No. 5,014,956, U.S. Pat. No. 4,828,211, U.S. Pat. No. 5,191,679, U.S. Pat. No. 5,072,909, U.S. Pat. No. 5,191,679, etc. However, when collapsing or extending out the drink holder, the user needs to bias the tray and the cup hoop separately, i.e., the tray and the cup hoop are not linked for synchronous movement. There are some other drink holder designs that use link means to couple a tray and a holder for synchronous movement between the extended position and the received position. Exemplars are seed in U.S. Pat. No. 5,342,009, US20130092808, U.S. Pat. No. 6,655,563, etc. However, according to these prior art designs, there are no support means for holding the tray and the holder securely in the extended position against vibration. Further, when the drink holder is collapsed, it has no means to keep the base frame or other pivot connection parts from sight. When a drink holder of any of these prior art designs is directly mounted in a luggage, it can compromise the appearance of the luggage.

SUMMARY OF THE INVENTION

The present invention has been accomplished under the circumstances in view. It is one object of the present invention to provide a combination luggage and drink holder assembly, which comprises a luggage and a drink holder mounted at one side of the luggage, wherein the drink holder comprises a base frame, a hoop and a tray respectively pivotally coupled to opposing top and bottom sides of the base frame, and two links coupled between the hoop and the tray for allowing the drink holder to be biased relative to the luggage between a received position where the drink holder is collapsed and closely attached to the luggage and an extended position where the drink holder extends out of the luggage for holding a beverage can or drink cup.

In an embodiment of the combination luggage and drink holder assembly, the hoop comprises a peripheral wall that surrounds the base frame and the tray when the drink holder is set in the received position; the tray has the bottom wall thereof configured for blocking up the locating hole of the hoop when the drink holder is set in the received position.

In another embodiment of the combination luggage and drink holder assembly, the base frame, the hoop and the tray are configured to provide stop blocks, elastic members and/or other supporting structures so that when the drink holder is set in the received position, the hoop and the tray can be securely held in position against vibration.

In yet another embodiment of the combination luggage and drink holder assembly, the drink holder is so designed that the hoop and tray can be synchronously moved between the received position and the extended position, the rear side of the hoop can be stopped at elastic members at the front side of the base frame to keep the drink holder securely in the extended position; when the drink holder is set in the received position, the hoop surrounds the base frame and the tray, and the bottom wall of the tray blocks up the locating hole of the hoop from sight.

DETAILED DESCRIPTION OF THE PREFERRED EMBODIMENTS

Figure 1:
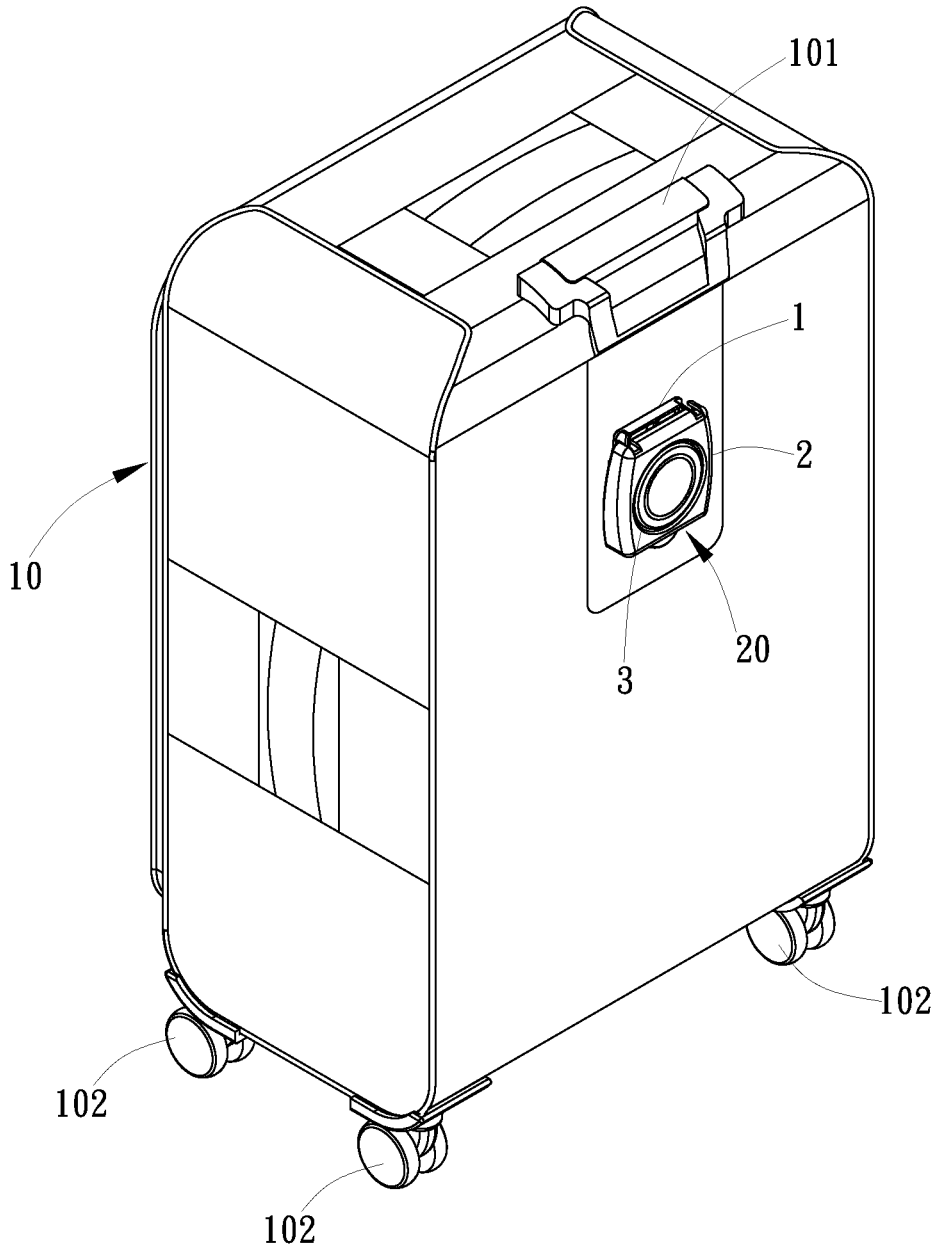
FIG. 1 is an oblique top elevational view of a combination luggage and drink holder assembly in accordance with the present invention.
Figure 2:
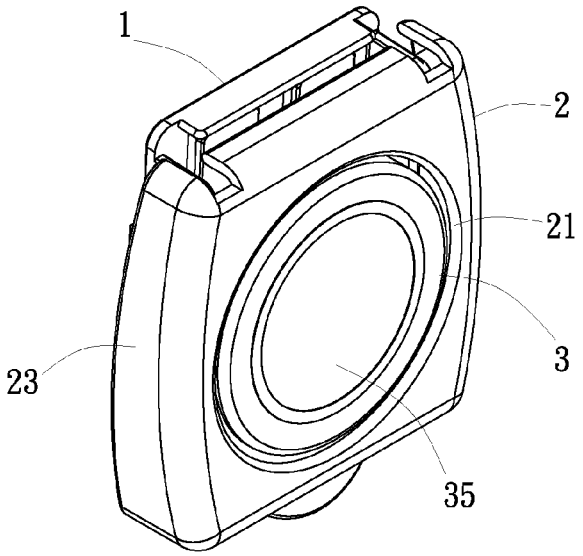
FIG. 2 is an oblique top elevational view of the drink holder of the combination luggage and drink holder assembly in accordance with the present invention.
Figure 3:
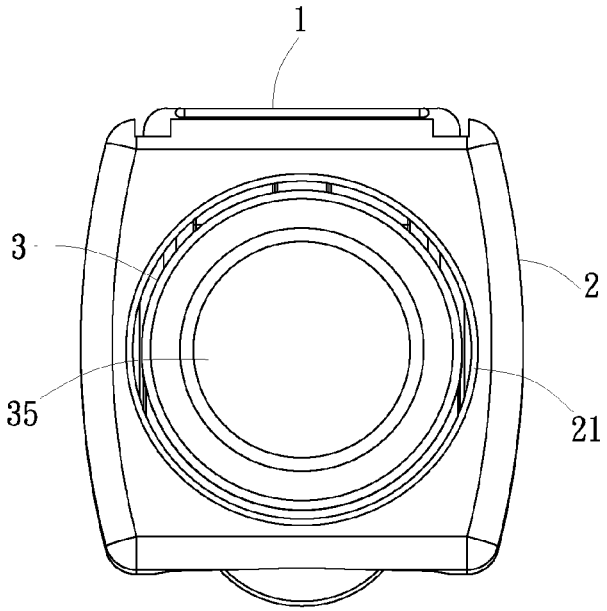
FIG. 3 is a front view of the drink holder of the combination luggage and drink holder assembly in accordance with the present invention.
Figure 4:
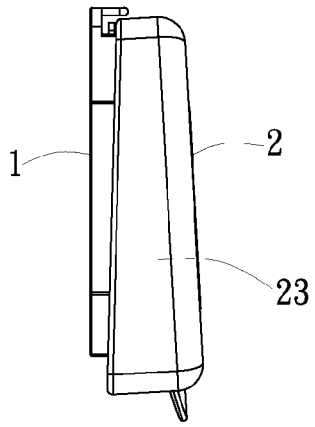
FIG. 4 is a schematic side view of the drink holder of the combination luggage and drink holder assembly in accordance with the present invention.

Referring to FIG. 1, a combination luggage and drink holder assembly in accordance with the present invention is shown. The combination luggage and drink holder assembly comprises a luggage 10, and a drink holder 20 mounted at one side of the luggage 10. The luggage 10 is a container for storing things, comprising a retractable handle 101 located at a back side thereof, four roller 102 pivotally mounted at a bottom side thereof. As shown in FIG. 2, FIG. 3 and FIG. 4, the drink holder 20 comprises a base frame 1, a hoop 2, a tray 3 and two links 4. The drink holder 20 is so constructed that the hoop 2 and the tray 3 can be synchronously moved by the links 4 between an extended position and a received position.

Figure 5:
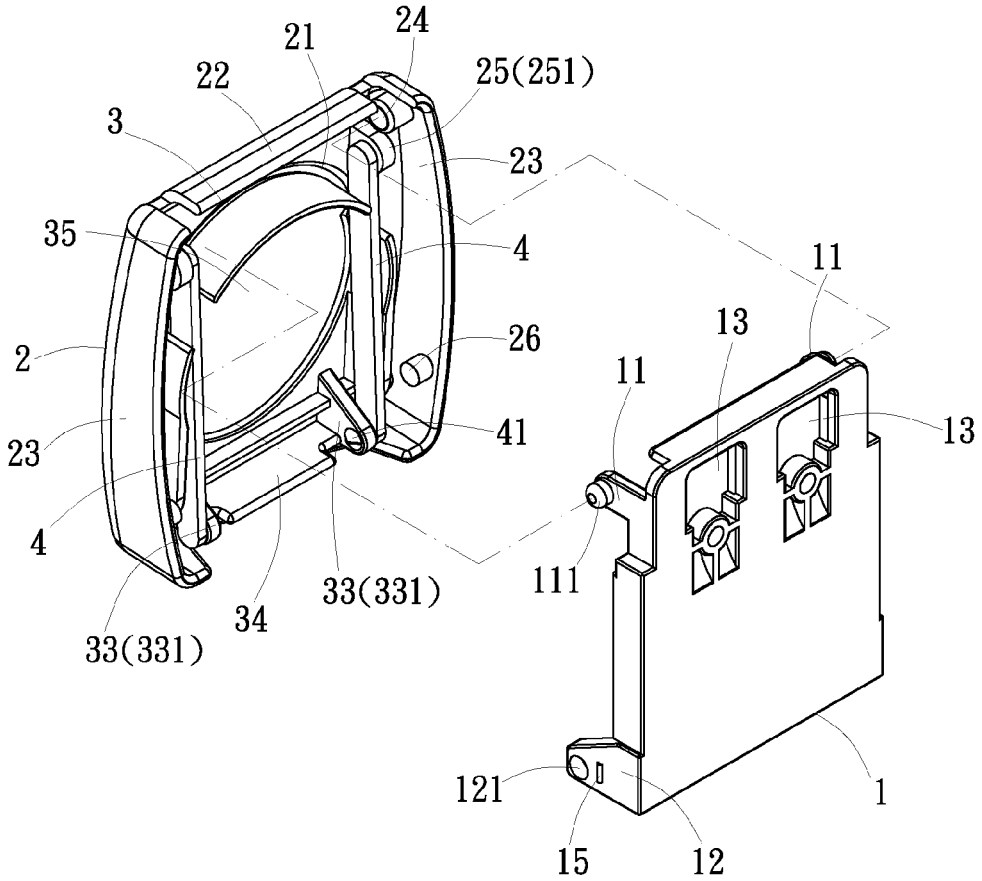
FIG. 5 is an exploded view of the drink holder of the combination luggage and drink holder assembly in accordance with the present invention.
Figure 6:
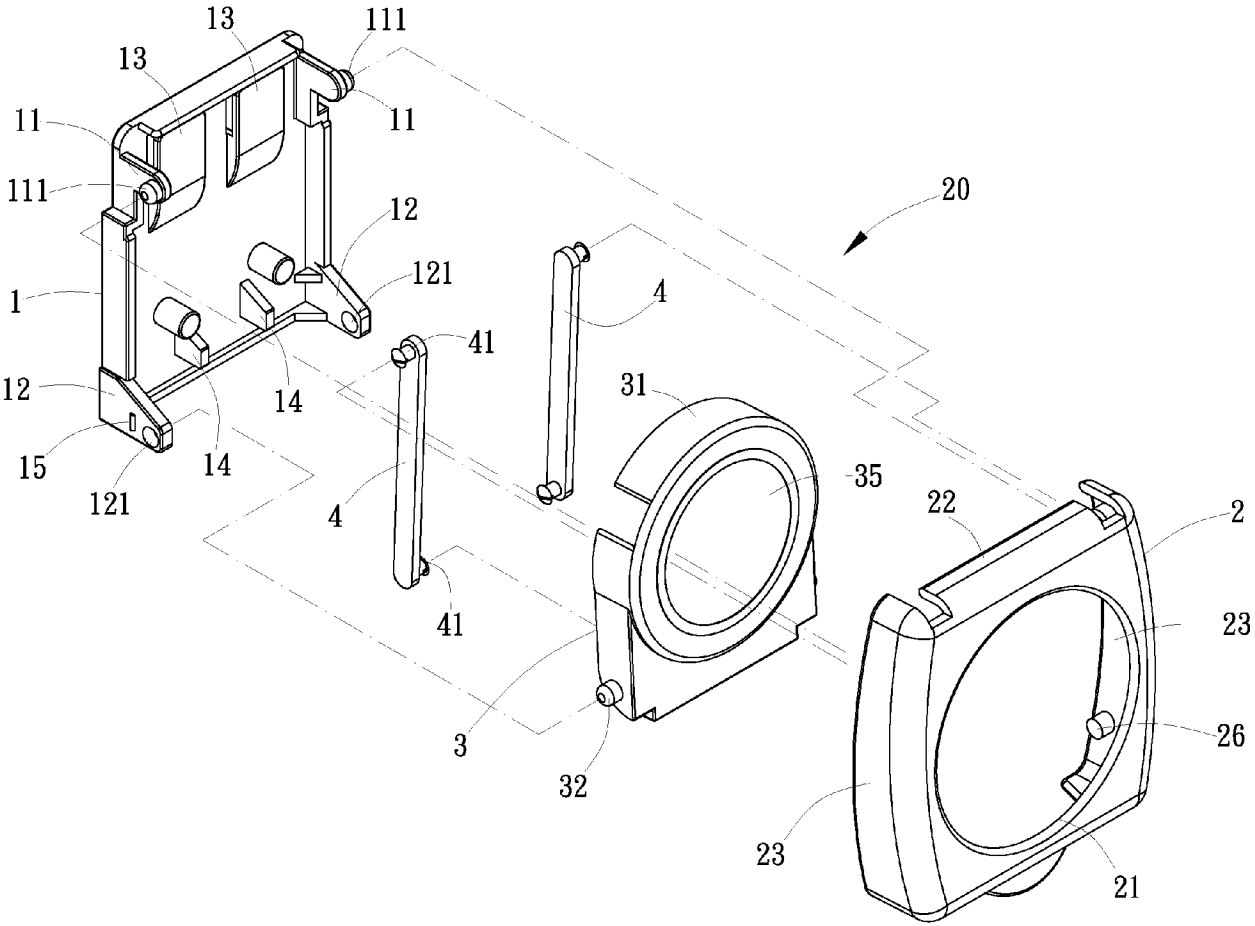
FIG. 6 is another exploded view of the drink holder of the combination luggage and drink holder assembly in accordance with the present invention.
Figure 7:
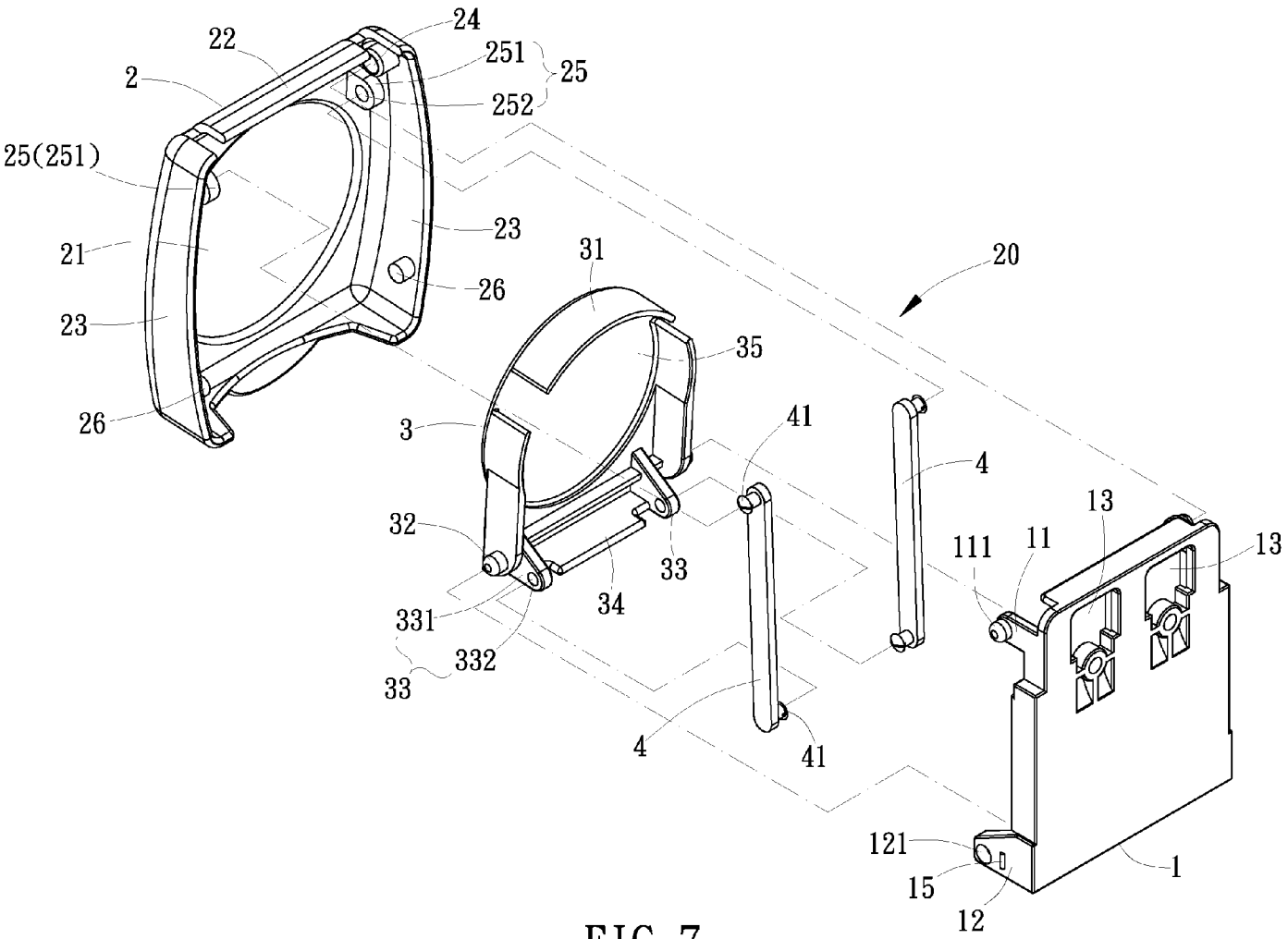
FIG. 7 corresponds to FIG. 6 when viewed from another angle.

Referring to FIG. 5, FIG. 6 and FIG. 7, the base frame 1 is a one-piece rectangular plate member made from a plastic material and affixed with a back wall thereof to the luggage 10, comprising two first pivot-connection lugs 11 bilaterally located at a top side thereof, two second pivot-connection lugs 12 bilaterally located at a bottom side thereof, and at least one, for example, two elastic members 13 located at a front side thereof and facing toward the hoop 2. Each first pivot-connection lug 11 comprises a first pivot-connection portion 111. Each second pivot-connection lug 12 comprises a second pivot-connection portion 121. The first pivot-connection portions 111 of the first pivot-connection lugs are pivotally connected to the hoop 2. The second pivot-connection portions 121 of the second pivot-connection lugs 12 are pivotally connected to the tray 3. Further, the elastic members 13 are adapted to stop against the hoop 2, keeping the hoop 2 in a horizontal position in the extended position.

Figure 9:
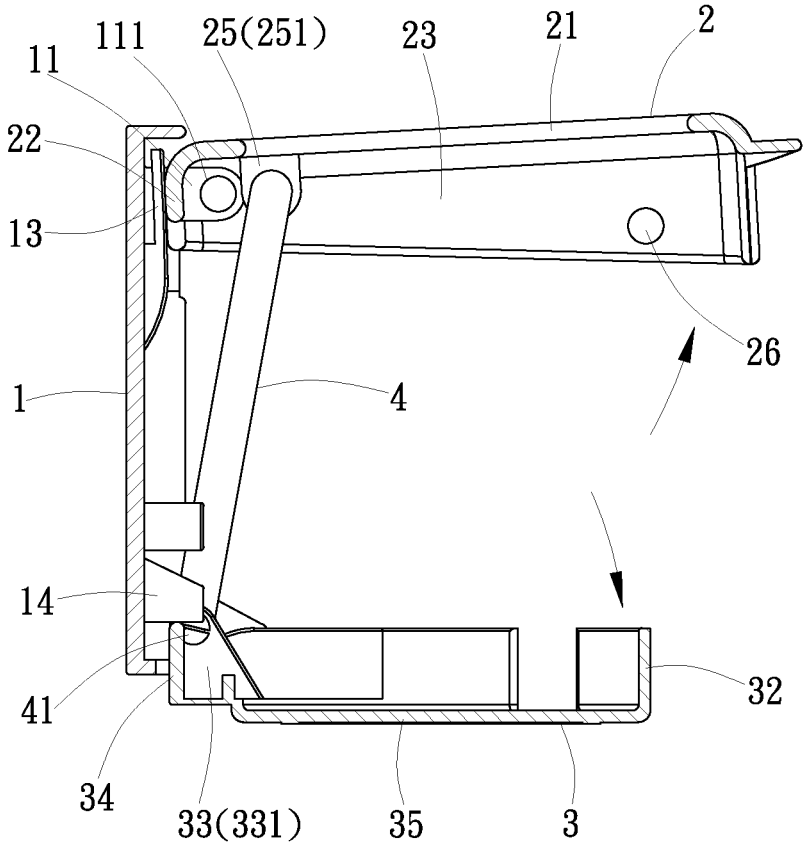
FIG. 9 a schematic sectional view of the present invention, illustrating the drink holder set in the extended position.
Figure 10:
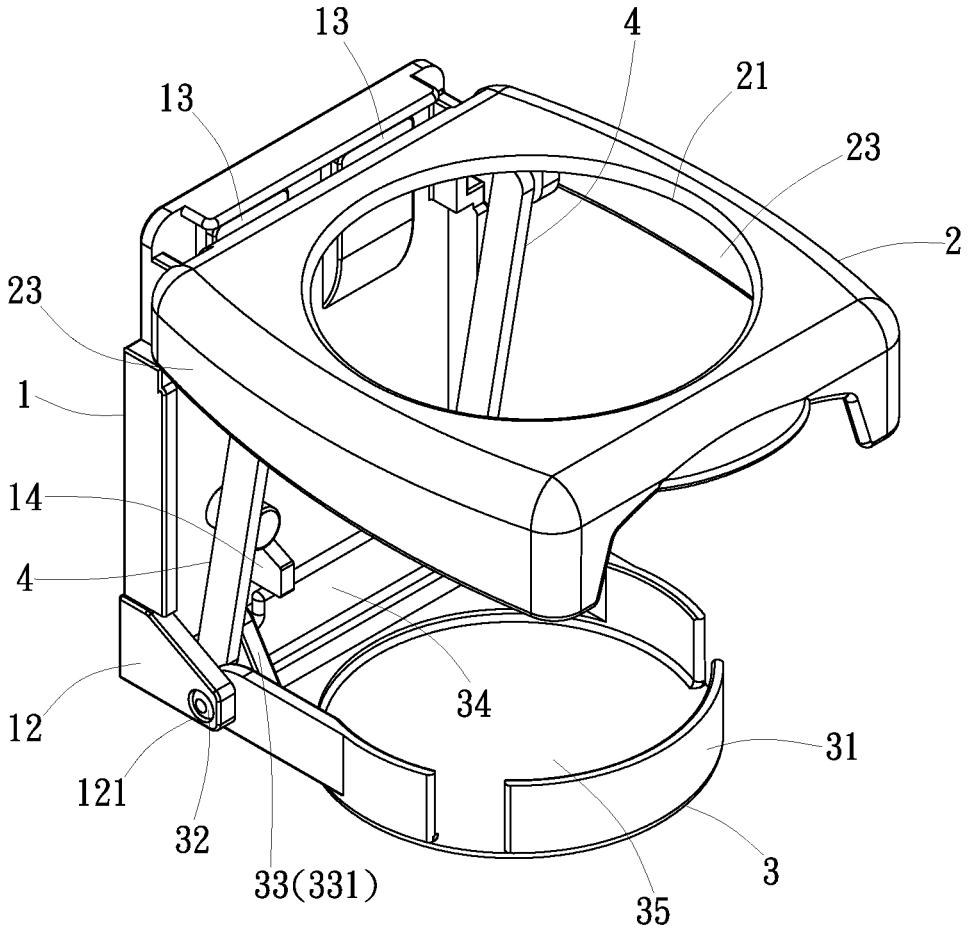
FIG. 10 is an oblique top elevational view of the present invention, illustrating the drink holder set in the extended position.

As illustrated in FIG. 5, FIG. 6 and FIG. 7, the hoop 2 is a one-piece rectangular rack made from a plastic material, comprising a circular or rectangular locating hole 21 located in the center thereof for holding a beverage can or drink cup, a first stop wall 22 vertically located at a rear side thereof, a first peripheral wall 23 vertically extending around the border thereof, two third pivot-connection portions 24 and two fourth pivot-connection portions 25 respectively bilaterally located at the first peripheral wall 23 and respectively disposed adjacent to the first stop wall 22. The third pivot-connection portions 24 are respectively pivotally coupled to the first pivot-connection portions 111 of the first pivot-connection lugs 11 of the base frame 1 (see FIG. 8). Thus, the hoop 2 can be biased upwards to the extended position and kept in a horizontal position in a perpendicular manner relative to the base frame 1 (see FIGS. 9 and 10) where the first stop wall 22 is abutted against the elastic members 13, or biased downwards to the received position where the hoop 2 is closely attached to the base frame 1 in a parallel manner (see FIG. 8) and the base frame 1 is hidden in the hoop 2 and surrounded by the first peripheral wall 23 of the hoop 2 (see FIG. 2).

As illustrated in FIG. 5, FIG. 6 and FIG. 7, the tray 3 is a one-piece circular or rectangular dish-like plastic member to be fitted into the locating hole 21 of the hoop 2, comprising a second peripheral wall 31, and two fifth pivot-connection portions 32 and two sixth pivot-connection portions 33 respectively and bilaterally located at the second peripheral wall 31. The fifth pivot-connection portions 32 are respectively pivotally connected to the second pivot-connection portions 121 of the second pivot-connection lugs 12 of the base frame 1. Thus, the tray 3 can be biased downwards to the extended position and kept in a horizontal position in a perpendicular manner relative to the base frame 1 (see FIGS. 9 and 10) for supporting the bottom wall of the beverage can or drink cup that is inserted into the locating hole 21 of the hoop 2, or biased upwards to the received position where the tray 3 is kept between the base frame 1 and the hoop 2 (see FIG. 8) with a bottom wall 35 thereof blocking the locating hole 21 of the hoop 2 (see FIG. 2) and where the base frame 1 and the tray 3 are hidden in the hoop 2 and surrounded by the first peripheral wall 23 of the hoop 2.

Figure 8:
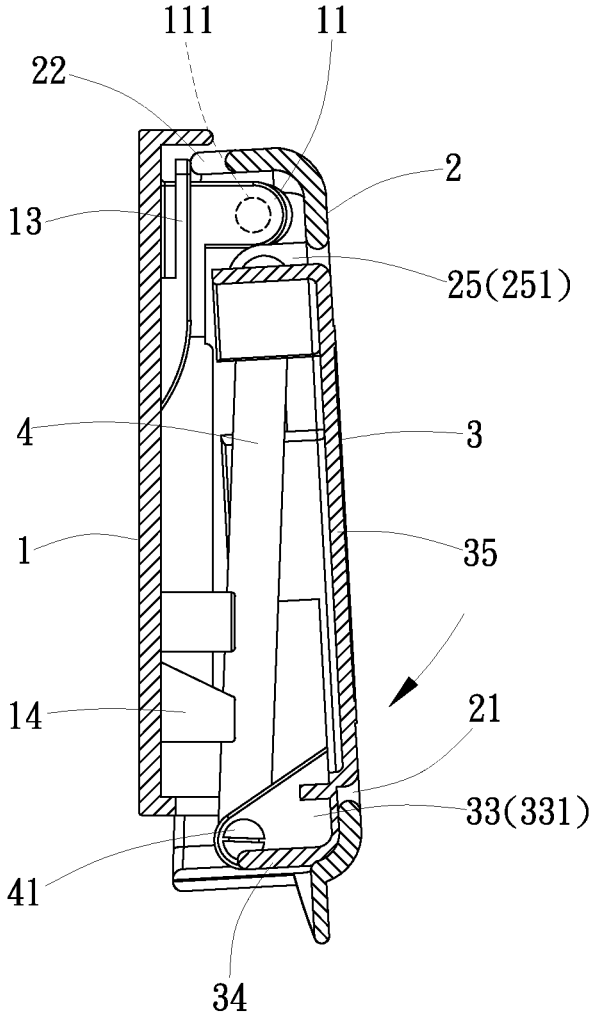
FIG. 8 is a schematic sectional view of the present invention, illustrating the drink holder set in the received position.

Referring to FIG. 5, FIG. 7 and FIG. 8, the two links 4 are plastic rod members, respectively pivotally connected between the fourth pivot-connection portions 25 of the hoop 2 and the sixth pivot-connection portions 33 of the tray 3. When the user biases the hoop 2 between the extended position and the received position, the hoop 2 and the tray 3 are synchronously moved by the links 4 to the extended position (see FIGS. 9 and 10) or the received position (see FIG. 8).

As shown in FIG. 6, the base frame 1 further comprises at least one, for example, two stop blocks 14 located at a front side thereof; the tray 3 further comprises a second stop wall 34 located at a rear side thereof. After the tray 3 is biased downwards to the extended position, the second stop wall 34 is stopped against the stop block 14 of the base frame 1 (see FIG. 9), holding the tray 3 in a horizontal position for supporting the bottom wall of the loaded beverage can or drink cup.

In order to keep the hoop 2 and the tray 3 positively in the received position, as shown in FIG. 5 and FIG. 6, the base frame 1 is configured to provide two first protruding portions 15 respectively disposed at two opposite lateral sides thereof. Preferably, the first protruding portions 15 are raised bumps on the surface of the base frame 1. Further, the hoop 2 comprises two second protruding portions 26 bilaterally located at the inner surface of the first peripheral wall 23. Preferably, the second protruding portions 26 are protruding pins extended from the inner surface of the first peripheral wall 23. After the hoop 2 is set in the received position, the second protruding portions 26 are respectively stopped at the first protruding portions 15 of the base frame 1.

The component parts of the drink holder of the prevent invention are preferably made from a plastic material using injection molding technique, and then directly assembled together without using any screws or other external fastening members, the combination luggage and drink holder assembly can be assembled rapidly and efficiently. Further, as illustrated in FIG. 6 and FIG. 7, the first pivot-connection portion 111 at each first pivot-connection lug 11 of the base frame 1 is a pivot pin; each third pivot-connection portion 24 at the first peripheral wall 23 of the hoop 2 is a pivot hole. By pivotally connecting the pivot pins of the first pivot-connection portions 111 of the base frame 1 to the respective pivot holes of the third pivot-connection portions 24 of the hoop 2, the hoop 2 is pivotally coupled to the base frame 1 and can be biased relative to the base frame 1 between the extended position and the received position. Further, the second pivot-connection portion 121 at each second pivot-connection lug 12 of the base frame 1 is a pivot hole; each fifth pivot-connection portion 32 at the second peripheral wall 31 of the tray 3 is a pivot pin. By pivotally connecting the pivot pins of the fifth pivot-connection portions 32 of the tray 3 to the respective pivot holes of the second pivot-connection portions 121 of the base frame 1, the tray 3 is pivotally coupled to the base frame 1 and can be biased relative to the base frame 1 between the extended position and the received position. Further, the fourth pivot-connection portions 25 of the hoop 2 and the sixth pivot-connection portions 33 of the tray 3 each comprise a base 251,331 and a pivot hole 252,332 located in the base 251,331; the links 4 each comprise a split pivot bolt 41 located at each of two opposite ends thereof and respectively pivotally coupled to the respective pivot holes 252,332 to pivotally coupled the hoop 2 and the tray 3 together.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A combination luggage and drink holder assembly, comprising a luggage, and a drink holder mounted at one side of the luggage, said drink holder comprising a base frame, a hoop, a tray and two links, wherein:

said base frame is a frame member joined to said luggage, comprising two first pivot-connection lugs bilaterally located at a top side thereof, two second pivot-connection lugs bilaterally located at an opposing bottom side thereof and at least one elastic member facing toward said hoop, each said first pivot-connection lug comprising a first pivot-connection portion, each said second pivot-connection lug comprising a second pivot-connection portion;

said hoop is a rack comprising a circular or rectangular locating hole located in the center thereof, a first stop wall located at a rear side thereof, a first peripheral wall extending around a border thereof, two third pivot-connection portions and two fourth pivot-connection portions respectively bilaterally located at said first peripheral wall and respectively disposed adjacent to said first stop wall, said third pivot-connection portions being respectively pivotally coupled to said first pivot-connection portions of said first pivot-connection lugs of said base frame so that said hoop is biasable upwards to an extended position and kept in a horizontal position in a perpendicular manner relative to said base frame where said first stop wall is abutted against said at least one elastic member and downwards to a received position where said hoop is closely attached to said base frame in a parallel manner and said base frame is hidden in said hoop and surrounded by said first peripheral wall of said hoop;

said tray is a dish-like plastic member, comprising a second peripheral wall extending around a border thereof and two fifth pivot-connection portions and two sixth pivot-connection portions respectively and bilaterally located at said second peripheral wall, said fifth pivot-connection portions being respectively pivotally connected to said second pivot-connection portions of said second pivot-connection lugs of said base frame such that said tray is biasable downwards to said extended position and kept in a horizontal position in a perpendicular manner relative to said base frame, and biasable upwards to said received position where said tray is kept between said base frame and said hoop and surrounded by said first peripheral wall of said hoop with a bottom wall thereof blocking said locating hole of said hoop;

said links are respectively pivotally connected between said fourth pivot-connection portions of said hoop and said sixth pivot-connection portions of said tray for enabling said hoop and said tray to be synchronously biased between said extended position and said received position.

2. The combination luggage and drink holder assembly as claimed in claim 1, wherein said base frame comprises at least one stop block located at a front side thereof; said tray comprises a second stop wall located at a rear side thereof and adapted for stopping against said at least one stop block of said base frame when said tray is biased to said extended position.

3. The combination luggage and drink holder assembly as claimed in claim 2, wherein said base frame further comprises two first protruding portions respectively located at two opposite lateral sides thereof; said hoop further comprises two second protruding portions respectively located at two opposite lateral sides thereof and adapted for engagement with said first protruding portions of said base frame to hold said hoop in said received position.

4. The combination luggage and drink holder assembly as claimed in claim 1, wherein each said third pivot-connection portion at said first peripheral wall of said hoop is a pivot hole;

said first pivot-connection portion at each said first pivot-connection lug of said base frame is a pivot pin pivotally coupled to the pivot hole of one respective said third pivot-connection portion of said hoop.

5. The combination luggage and drink holder assembly as claimed in claim 4, wherein said second pivot-connection portion at each said second pivot-connection lug of said base frame is a pivot hole; each said fifth pivot-connection portion at said second peripheral wall of said tray is a pivot pin pivotally coupled to the respective said pivot hole of said second pivot-connection portion at one respective said second pivot-connection lug of said base frame.

6. The combination luggage and drink holder assembly as claimed in claim 1, wherein said fourth pivot-connection portions of said hoop and said sixth pivot-connection portions of said tray each comprise a base and a pivot hole located in said base; said links each comprise a split pivot bolt located at each of two opposite ends thereof and respectively pivotally coupled to the pivot holes of said fourth pivot-connection portions of said hoop and said sixth pivot-connection portions of said tray to pivotally coupled said hoop and said tray together.

* * * * *